US007331223B2

(12) United States Patent
Zazovsky

(10) Patent No.: US 7,331,223 B2
(45) Date of Patent: Feb. 19, 2008

(54) METHOD AND APPARATUS FOR FAST PORE PRESSURE MEASUREMENT DURING DRILLING OPERATIONS

(75) Inventor: Alexander Zazovsky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 482 days.

(21) Appl. No.: 10/248,535

(22) Filed: Jan. 27, 2003

(65) Prior Publication Data

US 2004/0144533 A1 Jul. 29, 2004

(51) Int. Cl.
*E21B 47/06* (2006.01)

(52) U.S. Cl. ..... 73/152.51

(58) Field of Classification Search ..... None
See application file for complete search history.

(56) References Cited

U.S. PATENT DOCUMENTS

| | | | | |
|---|---|---|---|---|
| 3,934,468 | A * | 1/1976 | Brieger | 73/152.25 |
| 4,745,802 | A | 5/1988 | Purfurst | |
| 4,860,581 | A | 8/1989 | Zimmerman et al. | |
| 4,893,505 | A | 1/1990 | Marsden et al. | |
| 5,095,745 | A | 3/1992 | Desbrandes | |
| 5,233,866 | A | 8/1993 | Desbrandes | |
| 5,279,153 | A | 1/1994 | Dussan V. et al. | |
| 5,303,582 | A | 4/1994 | Miska | |
| 5,555,945 | A | 9/1996 | Schultz et al. | |
| 5,615,115 | A | 3/1997 | Shilling | |
| 5,622,223 | A | 4/1997 | Vasquez | |
| 5,703,286 | A | 12/1997 | Proett et al. | |
| 5,770,798 | A * | 6/1998 | Georgi et al. | 73/152.05 |
| 5,799,733 | A | 9/1998 | Ringgenberg et al. | |
| 5,803,186 | A | 9/1998 | Berger et al. | |
| 6,006,834 | A | 12/1999 | Skinner | |
| 6,026,915 | A | 2/2000 | Smith et al. | |
| 6,047,239 | A | 4/2000 | Berger et al. | |
| 6,157,893 | A | 12/2000 | Berger et al. | |
| 6,164,126 | A | 12/2000 | Ciglenec et al. | |
| 6,230,557 | B1 | 5/2001 | Ciglenec et al. | |
| 6,236,620 | B1 | 5/2001 | Schultz et al. | |
| 6,301,959 | B1 | 10/2001 | Hrametz | |
| 6,325,146 | B1 | 12/2001 | Ringgenberg et al. | |
| 6,340,062 | B1 | 1/2002 | Skinner | |
| 6,343,650 | B1 | 2/2002 | Ringgenberg et al. | |
| 6,427,530 | B1 | 8/2002 | Krueger et al. | |
| 2002/0185313 | A1 | 12/2002 | Jones et al. | |

FOREIGN PATENT DOCUMENTS

| | | |
|---|---|---|
| GB | 2312008 A | 10/1997 |
| GB | 2 333 308 | 7/1999 |
| WO | WO 01/33044 | 5/2001 |
| WO | WO 02/08570 | 1/2002 |
| WO | WO02/08571 | 1/2002 |

* cited by examiner

*Primary Examiner*—Hezron Williams
*Assistant Examiner*—Paul M West
(74) *Attorney, Agent, or Firm*—Matthias Abrell; Kevin P. McEnaney; Dale V. Gaudier

(57) ABSTRACT

A method and apparatus for measuring the pressure of a formation penetrated by a wellbore is provided. A downhole tool is positioned in the wellbore and a probe is extended therefrom into sealing engagement with the formation. A piston in the probe is retracted therein where by a cavity is defined for receiving a fluid from the formation. A pressure underbalance in the cavity draws fluid from the formation into the cavity. An oscillator may be used to fluctuate the flow of fluid into the cavity. A pressure gauge is used to measure the pressure of fluid in the cavity.

33 Claims, 4 Drawing Sheets

METHOD AND APPARATUS FOR FAST PORE PRESSURE MEASUREMENT DURING DRILLING OPERATIONS

BACKGROUND OF INVENTION

The present invention relates generally to the determination of various downhole parameters of a wellbore penetrated by a subterranean formation. More specifically, the present invention relates to techniques for determining downhole pressure during wellbore operations.

In a typical wellbore operation, a downhole drilling tool drills a borehole, or wellbore, into a rock or earth formation. During the drilling process, it is often desirable to determine various downhole parameters in order to conduct the drilling process and/or learn about the formation of interest. The downhole drilling tool may be provided with mechanisms for measuring and/or monitoring such downhole parameters. To further investigate the wellbore and the downhole parameters of interest, the drilling tool is removed and a wireline tool is lowered into the wellbore to take measurements and/or to take samples. Such techniques for determining downhole parameters are sometimes referred to as "formation evaluation."

Present day oil well operation and production involves continuous monitoring of various subsurface formation parameters. One aspect of standard formation evaluation is concerned with the parameters of downhole pressures and the permeability of the reservoir rock formation. Monitoring of parameters, such as pore pressure and permeability, indicate changes to downhole pressures over a period of time, and is essential to predict the production capacity and lifetime of a subsurface formation, and to allow safer and more efficient drilling conditions. Such downhole pressures may include annular pressure ($P_A$ or wellbore pressure $p_w$), pressure of the fluid in the surrounding formation ($P_p$ pore pressure), as well as other pressures.

During drilling of oil and gas wells using traditional downhole tools, it is common for the drill string to become stuck against the formation. A common type of sticking, known as differential sticking, occurs when a seal is formed between a portion of the downhole tool and the mudcake lining the formation. The pressure of the wellbore relative to the formation pressure assists in maintaining the seal between the mud cake and the downhole tool, typically when the tool is stationary. The hydrostatic pressure acting on the downhole tool increases the friction and makes movement of the drill pipe difficult or impossible. Monitoring downhole pressure conditions enables detection of the downhole pressure conditions likely to result in differential sticking.

Techniques have been developed to obtain downhole pressure measurements through wireline logging via a wireline, or "formation tester," tool. This type of measurement requires a supplemental "trip" downhole with another tool, such as a formation tester tool, to take measurements. Typically, the drill string is removed from the wellbore and a formation tester is run into the wellbore to acquire the formation data. After retrieving the formation tester, the drill string must then be put back into the wellbore for further drilling. Examples of formation testing tools are described in U.S. Pat. Nos.: 3,934,468; 4,860,581; 4,893,505; 4,936,139; and 5,622,223. These patents disclose techniques for acquiring formation data using probes positionable in fluid communication with the formation of interest.

A conventional technique for measuring pressure involves withdrawal of formation fluid and measuring the pressure relaxation with time. In conventional methods, tools with probes engage and press to the wall of the formation creating a seal and establishing fluid communication between the probe and the formation. In order to make an accurate formation pressure measurement, it is necessary to remove the mudcake, at the probe location. The mudcake removal step is necessary because mudcake prevents communication between the probe and formation (there is external mudcake at the interface of the formation but there can be some mudcake that penetrates the formation).

For the mudcake removal operation, the probe is typically provided with a pump used to create the underbalanced pressure that will cause the formation fluid to flow from the formation into the tool through the probe. This process cleans the interface between the tool and the formation and establishes communication between the tool and the formation. In conventional pressure measuring terms, this process is known as the "pretest" phase. When the fluid begins to flow into the probe, the pressure in the probe (the cavity) will drop quickly from the wellbore pressure below the formation pressure. After the pressure relaxation occurs, the pressure in the probe will start to increase. The pressure in the probe rises to a point that is close to the formation pressure.

The pretest operation reduces the pressure around the wellbore. Therefore, it is necessary to wait until the pressure relaxes/equalizes to a level close to the formation pressure. If substantial fluid is withdrawn during the pretest, but not enough time is allowed for the formation pressure to relax, then the pressure measurement will be inaccurate. The time required to wait for pressure relaxation can vary depending on the permeability of the formation and fluid viscosity. This wait can be on the order of several minutes. This delay, with the tool in a stationary position, may further result in disruption of the downhole operation and potentially cause the downhole tool to stick in the wellbore.

Most jobs involving pore-pressure measurement currently performed during drilling operations with commercial wireline tools are time-consuming operations. Among the main causes for this time consumption are the pretest and pressure equalization procedures, even when the formation permeability is high and the pressure behind the mudcake adequately represents the formation pressure. As previously mentioned, the removal of mudcake (external and internal) requires the withdrawal of filtrate and reservoir fluids from the formation, whereas the interpretation of the pretest requires monitoring pressure variations inside the cavity.

Since the cavity in the tool is about 100 $cm^3$ and the storage effect on the pressure inside the tool cannot be ignored, the amount of fluid that has to be withdrawn from the formation is relatively large. Usually, the amount of fluid withdrawn is about 20 $cm^3$. This withdrawal, in turn, leads to a significant pressure perturbation around the wellbore and, therefore, additional waiting time is necessary for subsequent pressure relaxation in the formation.

Other techniques have also been developed to acquire formation data from a subsurface zone of interest while the downhole drilling tool is present within the wellbore, and without having to trip the well to run formation testers downhole to identify these parameters. Examples of techniques involving measurement of various downhole parameters during drilling are set forth in U.K. Patent Application GB 2,333,308 assigned to Baker Hughes Incorporated, U.S. patent application Ser. No. 6,026,915 assigned to Halliburton Energy Services, Inc. and U.S. Pat. No. 6,230,557 assigned to the assignee of the present invention. Like the conventional wireline tools, these measurement devices also typically require removal of the filtercake to establish sufficient communication between the tool and the formation, and require a substantial delay for equalization of pressure before taking a measurement resulting in similar delays and potential sticking.

Still other techniques have been developed to measure pore pressures without requiring a pretest. For example, U.S. Pat. No. 6,164,126 assigned to the assignee of the present invention discloses an apparatus and method for measuring formation parameters using a probe embedded in the formation. However, this device requires delays to equalize the pressure of the device with the pore pressure to obtain an accurate measurement of the formation. Additionally, the device must penetrate the formation to obtain the measurement thereby causing damage to the formation which may impair fluid communication between the device and the formation, and which may cause difficulty in the operation of the drilling tool.

The acceleration of pore-pressure measurements following conventional procedures poses a significant hurdle. What is needed is a more efficient way to equalize the pressure on both sides of the tool-rock interface. The method of equalizing pressure in a timelier manner remains a paramount challenge. Therefore, there remains a need to further develop techniques which permit quick and accurate downhole pressure measurements. The downhole drilling operation, known pressure conditions and the equipment itself may be manipulated to facilitate downhole measurements.

It is desirable that techniques be provided to take pore pressure measurements using reduced volumes of formation fluid to generate quick pressure readings with reduced damage to the formation during testing. It is further desirable that such techniques be capable of providing one or more of the following, among others, adaptability to various wellbore and/or equipment conditions, usability in a wireline or drilling tool, capability of utilizing a reduced volume of formation fluid necessary for testing, capability of reducing the damage to the wellbore during testing, improved accuracy, simplified equipment, real time data, elimination of sticking risks, quick measurement and/or measurements during the drilling process. Such a technique would also preferably be adapted to penetrate the mudcake and take an immediate pressure measurement, measure pore pressure with minimum formation pressure disturbance, measure the pore pressure at the interface between the mudcake and rock during drilling operations, establish effective hydraulic communication between the formation and the tool during the measurement operation, and provide minimum disturbance of pore pressure around the wellbore.

SUMMARY OF INVENTION

This present invention proposes a method for determining pore pressure at the mudcake-rock interface during drilling operations, which may also significantly quicken pore-pressure measurements made with wireline logging tools or logging-while-drilling (LWD) tools. In the implementation of the present invention, it is necessary to establish hydraulic communication between the formation and the apparatus tool of the present invention. This tool can be a combination of a conventional probe and an oscillator (transducer with an oscillating vibrator).

In the method of the present invention, this probe is pressed against the wellbore wall and into the mudcake, by conventional hydraulic means, leaving a relatively small gap between the oscillator and the rock interface. After the probe is set, the pressure in the gap filled by mud and mudcake is reduced by retracting a cylindrical piston, with implanted oscillator located in the probe barrel a short distance into the probe and away from the mudcake, and decompressing the fluid inside the cavity of the probe. A brief waiting period may be necessary for the formation fluid to fill the volume in the probe created by retracting the piston. Following the piston retraction step, pressure oscillations are applied through the mud to the mudcake adjacent to the tool-rock interface using the oscillator implanted into the piston. Pressure equalization between the formation and the probe is achieved very quickly due to fluidization of the external mudcake and breaking of bridges in the pores of the formation matrix filled with internal mudcake. Pressure measurements are made at pressure equalization. This pore-pressure measurement method will not generate undesirable pore-pressure perturbation in the formation behind the probe interface because the confined cylinder volume filled with mud and mudcake is small. The method should be effective in both high and medium-permeability formations. Measurements in formations with lower permeabilities are usually offset by shallow mud invasion.

The present invention also involves the establishment of fluid communication between the probe and the formation with minimum pressure perturbations. This task can be achieved by reducing the cavity in the tool and the reduction of the amount of withdrawn fluid from the formation. The first step is to reduce the cavity in the tool using a solid piece of material (a piston) to fill the cavity. With this piston in place it is easier to create a huge pressure imbalance with very small volume, therefore one can control the amount of fluid being withdrawn from the formation and create high-pressure underbalance, which should be adequate to destroy the mudcake. This will allow the creation of high underbalance and help destroy mudcake hydraulic resistance.

The method proposed in this present invention describes a procedure that can equalize the pressure across the tool-rock interface almost without withdrawal of fluid from the formation by using low-frequency pressure oscillations in the small volume of fluid confined inside the tool chamber adjacent to the rock interface. This technique of pressure equalization enhancement enables control of pressure wave penetration depth into formation. This method fluidizes the external mudcake, destroys the bridges of solid particles in the zone of mud invasion and creates conditions for fast pressure redistribution between both sides of the tool-rock interface. This method replaces the time-consuming pretest procedure and subsequent pressure buildup, and thereby more efficiently establishes hydraulic communication between the measuring tool and the formation covered by mudcake.

In at least one aspect, the invention relates to an apparatus for measuring the pressure of an underground formation penetrated by a wellbore. The apparatus comprises a housing positionable in the wellbore, a probe operatively connected to said housing, a piston contained in said probe and axially movable therein, an oscillator operatively connected to the piston for fluctuating the flow of fluid into and/or out of the cavity and a gauge for measuring the pressure of fluid in the cavity. The probe is positionable in sealing engagement with a sidewall of the wellbore. The piston has an end positionable adjacent the sidewall of the wellbore and retractable therefrom whereby a cavity is defined for receiving fluid from the formation.

In another aspect, the invention relates to a method for measuring the pressure of an underground formation penetrated by a wellbore. The method comprises placing the a probe of a downhole tool in sealing engagement with a sidewall of the wellbore, retracting the piston within the probe such that an underbalance is created to draw fluid into the cavity, equalizing the pressure in the cavity to the pressure of the formation and measuring the pressure in the cavity. The probe has a retractable piston therein defining a cavity. Other aspects of the invention will be clear from the description provided herein.

DETAILED DESCRIPTION

Figure 1:
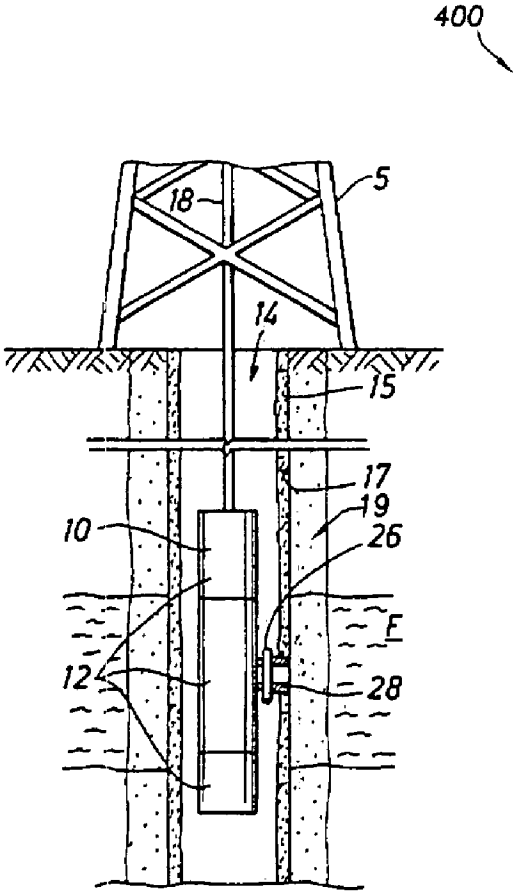
FIG. 1 is an elevational view, partially in cross-section, of a conventional drilling rig for creating a wellbore, and a down hole wireline tool deployed into the wellbore.

FIG. 1 depicts an example environment within which the present invention may be used. A downhole wireline tool 10 is deployable into bore hole 14 and suspended therein with a conventional wire line 18, or conductor or conventional tubing or coiled tubing, below a rig 5 as will be appreciated by one of skill in the art. The illustrated tool 10 includes a probe 28 positionable through the mudcake 15 and adjacent sidewall 17 of the borehole 14 and a surrounding formation F. An invaded zone 19 created during drilling surrounds the wellbore. The probe 28 is extended from the downhole tool using a standard extension device, typically a retractable piston.

The down hole tool 10 of FIG. 1 may be any type of wireline tool used for formation evaluation, such as the downhole tool depicted in U.S. Pat. Nos. 4,936,139 and 4,860,581 and assigned to the assignee of the present invention, the entire contents of which are hereby incorporated by reference herein in their entireties. While the present invention is usable in conjunction with a wireline tool, such as the one of FIG. 1, the present invention may also be used in other downhole tools, such as a downhole drilling or coil tubing tool. Additionally, the downhole tool may have alternate configurations, such as modular, unitary, wireline, coiled tubing, autonomous, Measurement-While-Drilling (MWD), Logging-While Drilling (LWD), tractor and other variations of downhole tools and/or components thereof.

Figure 2A:
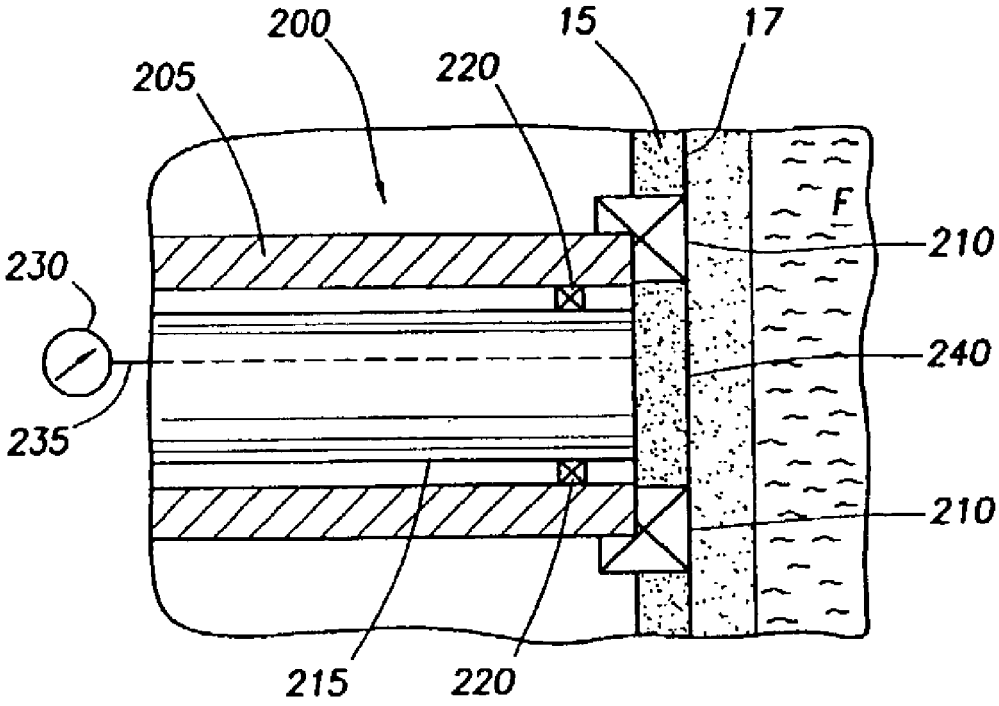
FIGS. 2A and 2B are schematic diagrams depicting a probe in engagement with a formation wall for performing pore pressure measurements.
Figure 2B:
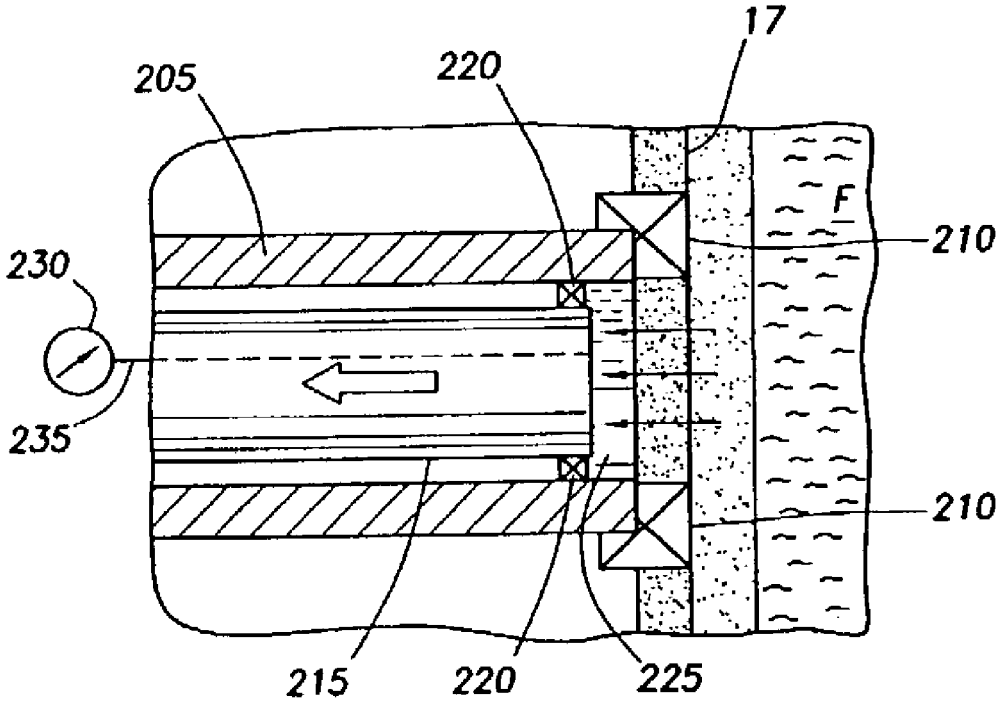

Referring now to FIGS. 2A and 2B, a probe 200 capable of performing a pore pressure measurement is depicted. FIG. 2A depicts the probe against the sidewall of the wellbore with an internal piston 215 in the extended position. FIG. 2B depicts the probe against the sidewall of the wellbore with the internal piston 215 in the retracted position. The probe 200 is adapted to sealingly engage the wellbore wall 17 and establish fluid communication with the formation F for determining the pore pressure thereof.

The probe 200 includes a probe barrel 205 having a packer (or probe seal) 210 at an end thereof for sealing engaging the sidewall 17 of the wellbore. The packer may consist of a durable rubber pad that is pressed against the sidewall 17 and layer of mud (or filtercake) 15. The probe 200 is preferably extended from the downhole tool and pressed hard enough such that the probe barrel 205 penetrates through the mudcake 15 to the sidewall 17 in order to form a hydraulic seal. The probe 200 may be extended using hydraulic actuation, worm gears, or other known devices, such as the extension mechanism of U.S. Pat. Nos. 4,936,139 and 4,860,581 assigned to the assignee of the present invention.

A piston 215 is positioned within the probe barrel 205 and axially movable therein. Preferably, the piston fits snugly within the barrel and moves slidingly therein. Seals 220 are positioned between the piston and probe barrel for creating the seal therebetween. The piston is connected to a displacement device (not shown) that operates to move the piston between the extended position of FIG. 2A and the retracted position of FIG. 2B.

As the piston 215 is moved from the extended to the retracted position, a cavity 225 is created in the probe barrel 205. As the piston is retracted and the volume in the cavity 225 increases, there is a substantial reduction of pressure in the cavity 225. This pressure reduction creates a substantial pressure underbalance between the formation and the probe. As a result of the created pressure underbalance, the pressure in the cavity 225 is lowered below the pore pressure and causes fluid from formation F to be drawn into the probe barrel 205. In other words, as the piston is retracted, formation fluid moves from the formation into cavity 225 as indicated by the arrows. As the fluid enters the cavity its continuity inside the cavity will be restored, and the pressure in the cavity will rise and equalize to the pressure of the formation.

Typically, the piston is retracted a distance to create a cavity sufficient to perform an accurate measurement. Preferably, the size of the cavity is kept at a small volume to reduce the amount of time for equalization of pressure. The reduced cavity size is also used to reduce the impact of the test on the wellbore and the surrounding formation, and the storage effect. Typically, a volume of from about 0.02 to about 1 cubic cm is preferred, but any volume may be used depending on the available time for performing the measurement.

A pressure gauge 230 is operatively connected to the piston via a conduit 235 to measure the pressure inside the cavity 225. The pressure gauge may be selectively activated or continuously monitor the pressure adjacent piston 215. When the probe 200 is in non-engagement with the wellbore wall, the probe will typically be in fluid communication with the wellbore. The gauge will, therefore, read the pressure of the wellbore or the annular pressure $p_w$. When the probe is in sealing engagement with the wellbore wall, the reading on the gauge will depend on the position of the piston. Where the piston is in the extended position (FIG. 2A), the pressure within the cavity typically reads a negligible amount. Where the piston is in the retracted position (FIG. 2B), the gauge will read the pressure of the cavity 225 which typically equalizes to the formation pressure ($P_o$).

Figure 3A:
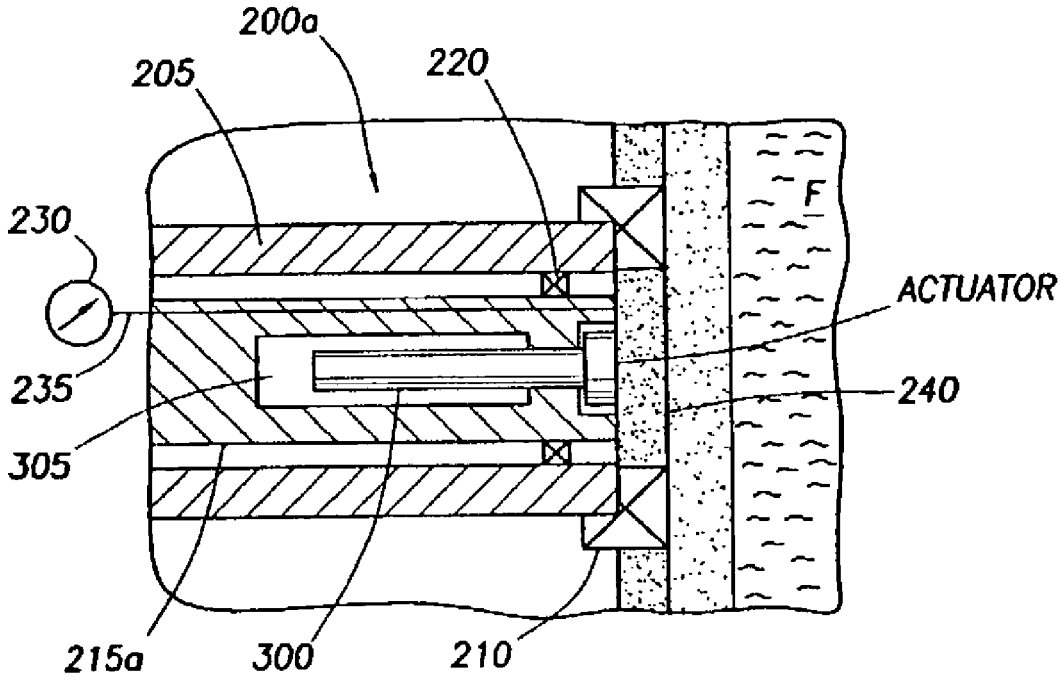
FIGS. 3A and 3B are schematic diagrams depicting the probe of FIGS. 2A and 2B incorporating an oscillator
Figure 3B:
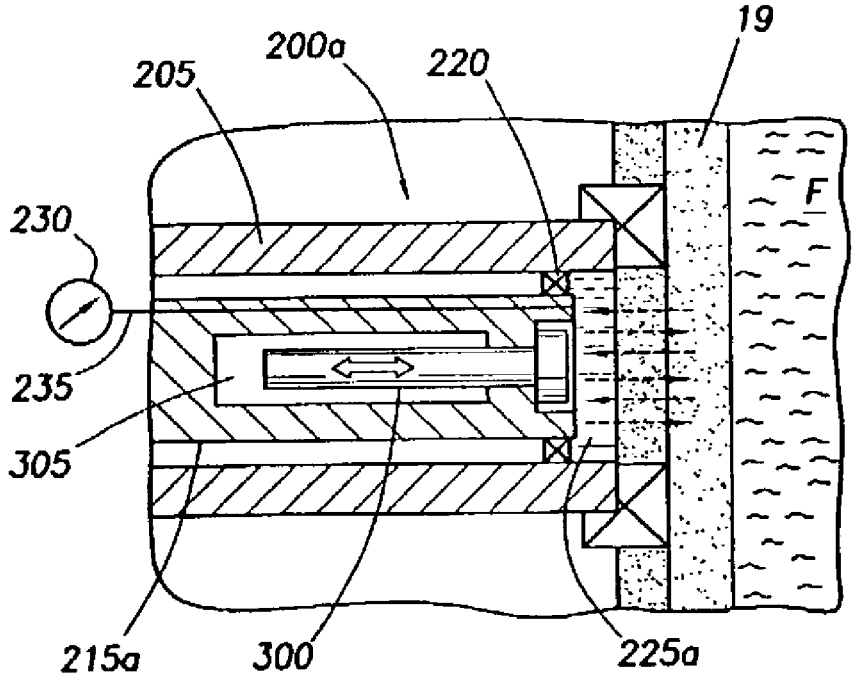

Referring now to FIGS. 3A and 3B, another embodiment of a probe 200*a* capable of performing the pore pressure measurements is provided. This embodiment is the same as the embodiments of FIGS. 2A and 2B, except that the piston 215*a* is provided with a chamber 305 adapted to operatively house an oscillator 300 therein. The oscillator is axially movable via electrical devices, such as piezoelectrical or magnetostrictive devices.

The oscillator axially oscillates between an extended and retracted position as shown in FIGS. 3A and 3B, respectively. As shown by the arrows in FIG. 3B, the oscillator creates fluid movement between the cavity 225*a* and the formation F to break up solid particles that collect in and around the probe. As formation fluid enters the cavity, solid particles in the invasion zone 19 may migrate into the probe and clog the formation interface thereby severely reducing the ability of the fluid flow into the probe. The oscillator may be provided to create vibration and/or fluid movement to loosen the solid particles in and around the cavity.

As depicted by the arrows in FIG. 3B, the oscillator preferably causes formation fluid to rapidly move back and forth at the entrance point of the formation fluid into the probe. This back and forth motion causes the solid particles in the fluid flow path to dislodge and enables the fluid flow into the probe to continue. The oscillator can be any conventional oscillating mechanism, such as the piezoelectric product manufactured by Piezomechanik Gmbh of Germany.

Figure 4:
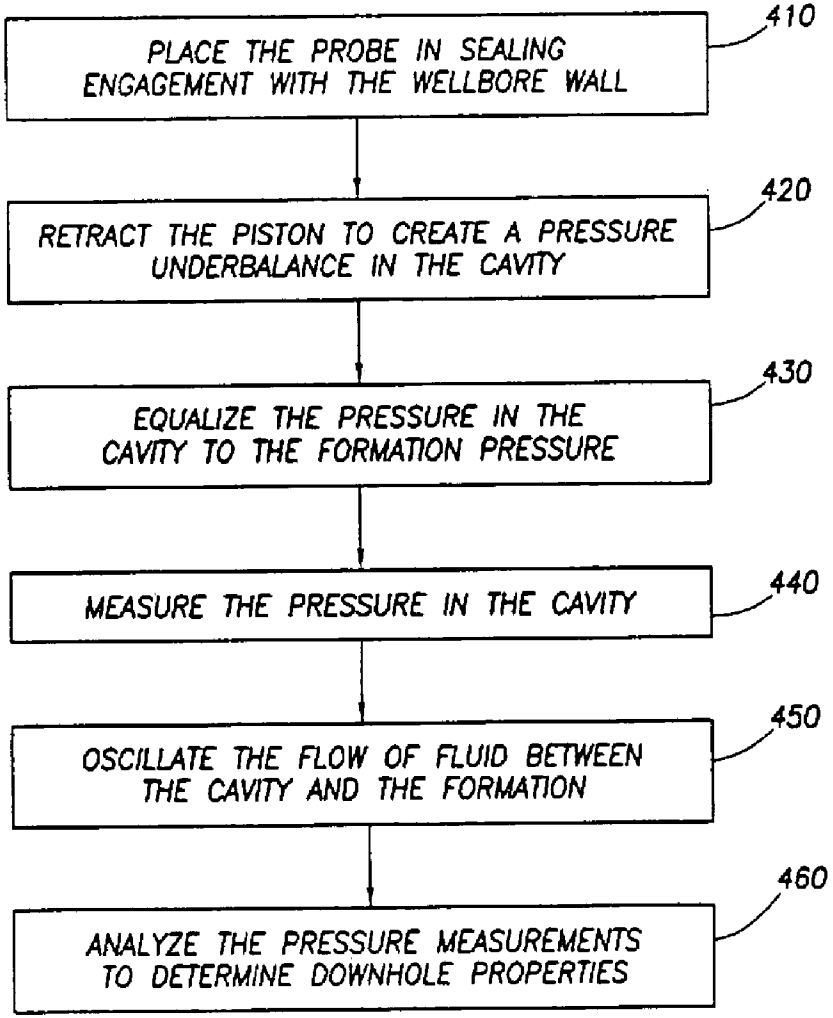
FIG. 4 is a flow diagram depicting a method of performing a pore-pressure measurement.

A method 400 for performing a pore pressure measurement is set forth in the flow chart of FIG. 4. The method 400 may be used in conjunction with the probes depicted in FIGS. 2A, 2B, 3A and/or 3B. First, the probe is set into sealing engagement with the wellbore wall (410). Typically, the downhole tool is anchored in place in the wellbore at the desired location to perform the measurement. The probe is then extended from the downhole tool and positioned into sealing engagement with the wellbore wall. It is preferable that the probe penetrates the mudcake to establish a seal with the tool-rock interface 240 (FIG. 2A).

Once a sufficient seal between the probe and the wellbore wall has been created, the next step 420 is to retract the piston 215 (FIG. 2B). A pressure underbalance is created between the cavity 225 and the formation F to decompress the fluid in the mixture of mud and mudcake in and around the cavity. This decompression state is achieved by quickly moving the piston 215 a short distance inside the probe barrel 205 and away from the tool-rock interface 240. The pressure underbalance also causes formation fluid to be drawn into the cavity 225.

Next, the pressure in the cavity must be allowed to equalize with the pore pressure of the surrounding formation 430. If the fluid continuity is broken, some waiting time may be required to restore the fluid continuity due to withdrawal of small amount of fluid from the formation. This waiting helps to break the mudcake integrity and to establish a hydraulic communication between the tool and the formation. The pressure gauge may be monitored to determine the status of the pressure in the cavity.

Once pressure equalizes, a pore pressure measurement may then be taken 440. While the gauge 230 may take continuous or selective measurements throughout the process, it is desirable to take at least one pore pressure measurement once equalization has occurred. Additional pressure measurements may also be taken of the wellbore when the piston is in non-engagement. Controllers may be used to selectively determine when to take pressure measurements, and to send signals or commands in response thereto.

An additional step 450 may be employed to oscillate the pressure in the cavity (FIG. 3B). After the fluid continuity inside the cavity is restored and the pressure buildup is confirmed, the oscillator 300 moves back and forth to prevent solid particles from arching and bridging. The oscillator may be selectively or continuously activated at variable or constant rates to maintain the fluidization and homogenization of the mixture of fluid and external mudcake inside the cavity, increase pressure transmissibility, break up bridges of solid particles in the formation and/or prevent repeated bridging of the particles mobilized by the flow under the applied pressure underbalance. Pressure measurements may be taken 440 before, during and/or after oscillation.

When done in combination with drilling procedures, the steps of drilling the wellbore, advancing the bit, and/or terminating the drilling operation may also be performed. With wireline tools, the drilling tool may be removed to permit lowering of the wireline tool into the wellbore and taking pressure measurements. The pressure measurements may be performed alone or in combination with other downhole operations, such as fluid sampling, coring or other known operations.

An analysis of the pressure measurements may be performed to determine various downhole characteristics 460. This step may be performed throughout the method as desired. The information obtained may be used to make decisions, such as whether or not to reseal, retest, accept various readings, etc.

Various assumptions may be made in performance of the analysis. For example, the pressure underbalance by the displacement of the piston 215 may be determined for the given operation. In a conventional method, a pretest is usually carried out with relatively slow displacement of the piston attached to the hydraulic pump in order to avoid applying excessive drawdown. Slow displacement allows control of the pressure perturbation induced by the pretest in the formation. By way of example, a pretest operation may have a production rate in high-permeability formations of about 1 $cm^3/s$, a probe internal diameter of approximately 0.5 in. and a suction area of about 1.3 $cm^2$ and a piston displacement rate v of about 0.8 cm/s.

Figure 5A:
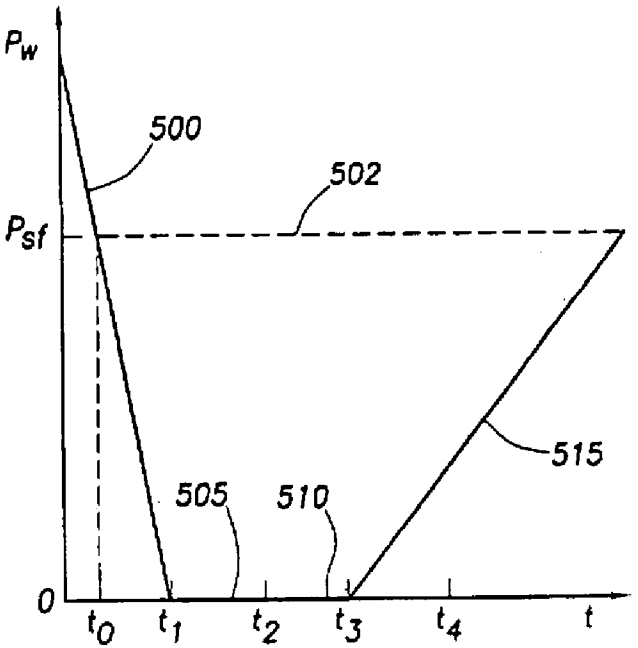
FIGS. 5A and 5B are graphical diagrams depicting the pressure and volume variation, respectively, in the cavity created by the piston displacement.
Figure 5B:
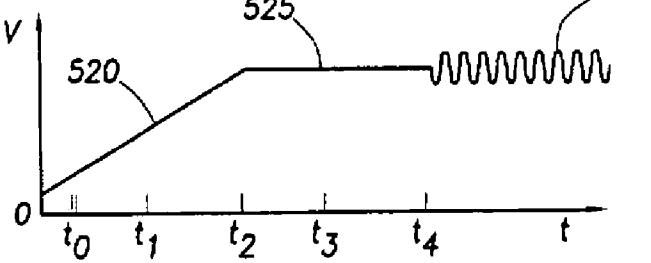

To equalize the pressure quickly using the new probe, a high underbalance is typically created within a small cavity. Reducing the cavity volume and moving the piston at a higher velocity should help to achieve this underbalance. A graphical representation of the pressure variation in the cavity is shown in FIG. 5 where a few phases can be distinguished. The upper graph (FIG. 5A) depicts pressure versus time and lower graph (FIG. 5B) depicts the cavity volume variation versus time for the operation described in FIG. 4.

As shown in FIG. 5A, Initially, at time=0, the pressure is at wellbore pressure $p_w$. The pressure drops well below the sand face pressure $p_{sf}$ (502) at time $t_0$ until pressure=0 at time $t_1$. The line representing this decompression of cavity is depicted as line 500. Between the time $t_0$ and $t_1$, the fluid continuity is broken, but the piston continues to retract along line 505 at pressure=0 until time $t_2$. From time $t_0$ to $t_3$, fluid flows into the cavity from the formation as depicted by line 510. At time $t_3$, the fluid continuity is re-established in the cavity and pressure begins to increase as depicted by line 515. If desired, oscillation may begin as set forth in step 450 of FIG. 4 preferably some time after $t_3$. During buildup 515, it may be desirable to keep solid particles loose, prevent clogging and/or enhance pressure equalization.

The corresponding volume changes of the cavity for the same times are depicted in FIG. 5B. The volume in the cavity increases as depicted by line 520 until time $t_2$. The volume remains constant from time $t_2$ to time $t_4$ as depicted by line 525. At time $t_4$, oscillations occur that effectively vary the volume as depicted by the fluctuating line 530.

Estimation of piston displacement for full decompression of fluid inside the cavity is determined by estimating the initial cavity volume and taking into account fluid compressibility while neglecting fluid flow into the cavity. The cavity volume $V_d$ is determined by the following equation:

$$V_d=\pi r_p^2\delta \tag{1}$$

where $r_p$ is the internal radius of the probe and δ is the initial gap between the rock surface and the piston. The variation of the cavity can be expressed as follows:

$$\Delta V_d=\pi r_p^2\Delta\delta \tag{2}$$

where Δδ is the piston displacement. If the flow from the formation is neglected, the displacement Δδ corresponding to a full decompression of the fluid is represented by the following equation:

$$\Delta\delta=\delta\Delta p/K \tag{3}$$

where $\Delta p=p_w$ is the pressure variation and K is the bulk modulus of fluid or the mixture of fluid and mud cake. For example, using the following data: Δp=20 MPa and K=1 GPa, yields the following:

$$\Delta\delta\approx 0.02\delta \tag{4}$$

i.e. the piston displacement to the distance on the order of 2% of the initial gap, which should be enough for the total decompression of the fluid inside the cavity. If, for example, δ=1 mm, then Δδ≈20 μm.

In reality, the fluid decompression caused by piston displacement is offset by the fluid flow from the formation under applied underbalance. It may be difficult to estimate this effect accurately because the permeability of the formation near the interface is damaged by the mud invasion. Permeability can be very low in a thin layer adjacent to the interface and may change dramatically during reverse flow from the formation.

Once the velocity and piston displacement is known, the time $t_1$ may be determined from the following equation:

$$t_1=\Delta\delta/w$$

where w is the known piston displacement rate.

The time $t_3$ may then be determined from the volume of fluid q produced from the formation to re-establish fluid continuity in the cavity. To estimate the volume of fluid q produced from the formation, there is an assumption that the formation property is uniform versus the distance from the interface and that the flow is one-dimensional. Another assumption is that the drawdown is constant and equal to its maximum value $\Delta p=p_\omega$. Then, the volume produced for the time t can be calculated according to the following equation:

$$q=\frac{2\pi r_y^2 k\Delta p}{\mu\sqrt{\pi\eta}}\sqrt{t},\qquad \eta=\frac{kB}{\varphi\mu} \tag{5}$$

where η is the pressure diffusivity, k is the formation permeability, μ is fluid viscosity, ϕ is formation porosity and B is the bulk modulus of the formation saturated with fluid, which can be approximated by using the bulk modulus of fluid, i.e. B≈K.

The coordinate of the fluid front propagating from the interface into the cavity is given by the formula $$\Delta\delta_f=\frac{q}{\pi r_p^2}=2\Delta p\sqrt{\frac{\varphi k t_f}{\pi\mu B}} \tag{6}$$

and, therefore, the time $t_f$ of filling the volume created by the piston displacement can be estimated as $$t_f=\frac{\pi\mu B}{4\varphi k}\left(\frac{\Delta\delta_f}{\Delta p}\right)^2. \tag{7}$$

An assumption is made that the permeability is equal to the initial permeability of the formation, k=10 mD. Then, using the same data as above and $\Delta\delta_f$=1 mm, which correspond to the piston displacement from the interface to 1 mm, then based calculations of equation (7) $t_f$≈1 s. In reality, this time can be longer due to permeability damage and delay in restoration of the original formation conductivity during reverse flow. The term $t_f$ may be used as an estimation of $t_3$.

The identified time, $t_f$, can be used to estimate the velocity of piston displacement, $w_p$, which enables us to apply maximal drawdown along line 500 to the rock interface $$w_p > w_f \approx \frac{\Delta\delta_f}{t_f}. \tag{8}$$

By way of example, the critical velocity, $w_f$, may be of the order of 1 mm/s. This velocity is much smaller than the pretest piston displacement rate w≈8 mm/s of conventional pretest procedures that use much larger dead volume.

Where it is desirable to perform the oscillation step 450 (FIGS. 3A, 3B and 4), further analysis may be performed. Oscillating acoustic energy or vibration is widely used in different measurements in the oil and gas industry with varying success. Successful applications include the productivity/injectivity enhancement after well completion, the breaking of capillary locks around oil and gas wells, the cleaning of gravel packs impaired by fines migration, perforation cleanup, and the enhancement of chemical reactions during scale removal and acidizing. The range of frequencies used in these applications varies significantly from ultrasonic to a few Hz. The liquefaction of soils induced by earthquakes is also well-known phenomenon. Thus, the application of pressure oscillations to the loosening of external mudcake and the mobilization of internal mudcake is consistent with its other applications. One has to distinguish between the two mechanisms mentioned above, i.e. the fluidization of the external mudcake and the mobilization of the internal mudcake, because they may require different frequencies and pressure amplitudes to be efficient.

An assumption is made that the velocity of pressure waves propagation in porous media, $v_p$, is usually much higher than the velocity of convective transport in it, $v_c$. The ratio $v_p/v_c$, is estimated as K/(ϕΔp), where K is the bulk modulus of the formation saturated with fluid, ϕ is the porosity and Δp is the differential pressure. For the typical data K=1 GPa, ϕ=0.25 and Δp=1 MPa, one obtains $v_p/v_c=4\times10^3$. This provides that pressure equalization between a confined tool volume and the formation is reached easier and faster than waiting for fluid withdrawal and subsequent pressure relaxation of conventional formation testers.

Assumptions may also be made based on the features of typical pressure profiles around a wellbore during the drilling operation. If the formation permeability is high, the mudcake is effectively built at the wellbore wall. The permeability is low compared to the formation permeability and the initial pressure build-up behind the mudcake dissipates quickly to the level of the far-field formation pressure. Thus, the main pressure drop between the wellbore and the formation occurs across the mudcake even if the zone of mud invasion is not thin when compared to the mudcake thickness. Conventional pretest procedures, however, perturb the pore pressure well behind the invasion zone, extending the time of pressure relaxation. The waiting time for fluid withdrawal and pressure relaxation after conventional pretest becomes unnecessary where the main hydraulic resistance associated with the filter cake is effectively destroyed. The applied pressure underbalance superposed with pressure oscillation presented in this measurement method assists in destroying the main hydraulic resistance in the mudcake.

The pressure amplitude, $\Delta p$, which could be created by the oscillator, depends on the velocity of fluid displacement by the oscillator, $\omega$. If the surface area of its actuator is equal to the surface area of the probe and, therefore, the flow inside the cavity can be considered as one-dimensional, the estimate for the pressure amplitude can be obtained using the water hammer theory based on the following equation:

$$\Delta p=\rho_f C_f \omega \tag{9}$$

where $\rho_f$ is the density of fluid (suspension) inside the volume, $\omega$ is the movement of the oscillator 300 during oscillation and $C_f$ is the sound velocity in it. The pressure wave reflections from the rock surface can double this pressure amplitude. The displacement of the actuator is not involved in equation (9) but it becomes important when the reflection wave interacts with the actuator. Substituting into equation (9) $\Delta p=0.1$ MPa, $\rho_f=10^3$ kg/m$^3$ and $C_f=10^3$ m/s, the velocity obtained is $\omega=10$ cm/s. Currently available commercial oscillators can move actuators much faster and, therefore, high-pressure amplitudes can be easily created.

For periodic displacements of the oscillator, the relationship (9) between the pressure amplitude $<\Delta p>$ and the velocity amplitude $<\omega>$ may be expressed according to the following equation:

$$<\Delta p>=\alpha\rho_f C_f<\omega> \tag{10}$$

where the parameter $\alpha<1$ depends on the geometry of the cavity, the oscillator and its dimensionless displacement amplitude.

Figure 6:
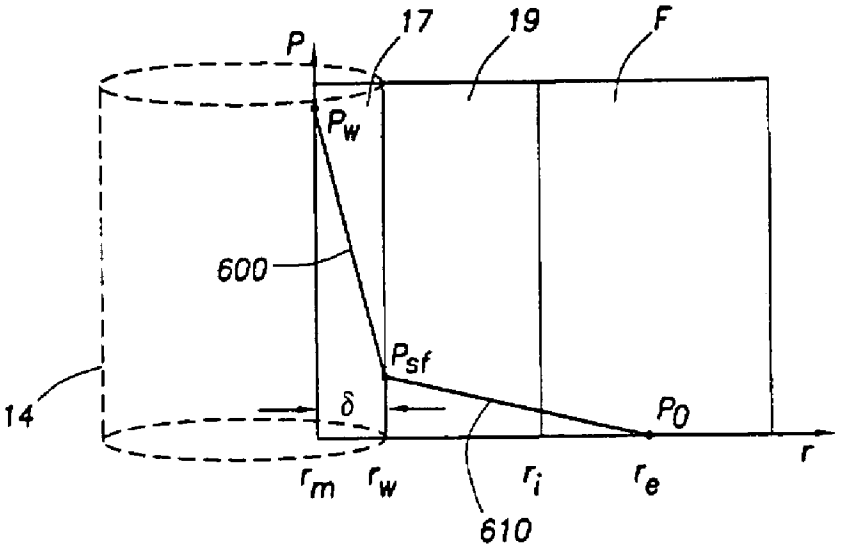
FIG. 6 is a graphical diagram depicting a pressure profile around a wellbore at the beginning of a pore pressure measurement.

The schematic pressure profile around a wellbore 14 during pore-pressure measurement in relatively high-permeability formation is shown in FIG. 6. The graph of FIG. 6 schematically depicts pressure versus the radial coordinate r. The coordinate $r_w$ is the radius of the wellbore and $r_m$ is the radius of the wellbore minus the thickness of the mudcake 17. Thus, $\delta$ is the thickness of the mudcake 17. The coordinate $r_i$ is the radius of the wellbore plus the thickness of the invaded zone 19. The coordinate $r_e$ is the external radius of the formation. The pressure at $r_m$ is the wellbore pressure $p_w$. The pressure at $r_w$ is the sandface pressure $p_{sf}$. The pressure drop from $r_m$ to $r_w$ and from $p_w$ to $p_{sf}$ is represented by line 600. The pressure drop from $r_w$ to re and from $p_{sf}$ to $p_o$ is represented by line 610.

The wellbore pressure, $p_w$, is higher than the far-field formation pressure, $p_o$, and the main pressure drop occurs across the mudcake. In this case, the sand face pressure, $p_{sf}$ may be considered a good approximation of the formation pressure.

In order to estimate the formation permeabilities for which this kind of pressure profiles are typical, the leak-off rate through the mudcake, $q_f$, and the formation, q, at the same pressure overbalance applied, $\Delta p=p_w p_o$ is compared based on the following equations:

$$q_f=\frac{2\pi r_w k_f h}{\mu}\frac{\Delta p}{\delta},\qquad q=\frac{2\pi kh}{\mu}\frac{\Delta p}{\log\left(\frac{r_e}{r_w}\right)} \tag{11}$$

where $r_w$ is the wellbore radius, $r_e$ is the external radius of formation, $k_f$ is the mudcake permeability, k is the formation permeability, $\delta$ is the mudcake thickness, $\mu$ is the fluid viscosity and h is the formation thickness.

The ratio of these leak-off rates characterizes the mudcake conductivity with respect to the hydraulic conductivity of the formation $$\frac{q_f}{q}=\frac{k_f rw}{k\delta}\log\left(\frac{r_e}{r_w}\right). \tag{12}$$

Substituting into equation (12) the following data by way of example: $k_f=1$ μD, k=10 mD, $r_w=0.1$ m, $\delta=3$ mm and $r_e=100$ m, one obtains $q_f/q\approx 3\times10^{-2}$. The sand face pressure $p_{sf}$ represents the formation pressure where $k\geqq 10$ mD. For formation permeabilities less than 10 mD, the difference $p_{sf}p_o$ may not be small when compared to the applied overbalance, $\Delta p$, and the formation pressure will be supercharged.

Thus, the main pressure drop to be eliminated is localized within the external mudcake and in the thin near-surface formation layer. The application of a large pressure gradient across a thin external mudcake may significantly stratify its density, porosity and permeability. The shaking of mudcake by pressure oscillation is used to make the mudcake property more uniform and increase its overall pressure transmissibility. The pressure oscillation in porous medium clogged by the internal mudcake operates to increase distances between solid particles, break the bridges and arches formed during unidirectional leak-off flow from the wellbore and, finally, increase its pressure diffusivity. The rate of pressure equalization may be affected by the depth of mud invasion, the frequency of pressure oscillation, the oscillator standoff, and the initial pressure drop inside the cavity.

By designing the size distribution of solids in mud, the concentration of solids in the invasion zone drops rapidly with the distance from the wellbore wall. This means that the additional hydraulic resistance, induced by mud invasion, has to be localized primarily within a thin sealing layer adjacent to the rock interface, preferably of the order of a few grain sizes. The packing of solid particles in the pore space inside this layer is preferably dense. Behind this layer, the concentration of particles is preferably smaller to generate high hydraulic resistance during invasion by formation of bridges and arches, which are kept stable by the pulling Stokes forces applied to particles by flowing fluid. After the sealing of the rock interface by the mudcake, these internal bridges become unstable due to dissipation of stabilizing forces and can be broken by changing the direction of flow. The invaded particles, however, can be mobilized again by the fluid flow in any direction creating bridges and reducing the transmissibility of pressure through the formation. The conventional cleanup of mudcake typically takes long time and requires larger production volume than it should be necessary for the convective transport of particles from the invasion zone to the wellbore. The fluidization of solids inside the pore volume by pressure oscillation is used to accelerate the pressure equalization and to reduce the repeated bridging of mobilized particles inside the invasion zone of a formation that responds typically to conventional mudcake cleanup after well completion.

An estimate of the frequency of pressure oscillation needed to achieve the pressure equalization within a thin layer adjacent to the rock surface may be performed without the requirement of removing solid particles from the invasion zone and while preventing bridges and arches from forming inside the pore volume they fill. The forming of arches and bridges may be achieved by controlling the chaotic movement of particles inside the pores they occupy. In situations where high differential pressure exists across the layer with densely packed particles, the particles can be mobilized by flow and then will start bridging inside the necks of pores in which they are confined. To reduce this effect, the particle movement must be intermittently reversed, i.e. in the direction opposite to the main flow. Obviously, the optimum pressure oscillation frequency is determined by the time $t_b$ that it takes for the average particle to travel to the neck of the pore. This time can be estimated based on the following equation:

$$t_b \approx r_o/u \tag{13}$$

where $r_o$ is the average por radius and u is the average particle velocity.

Assuming that the particle velocity is equal to the fluid flow velocity, one can estimate u using the Darcy law $$u = -\frac{k}{\phi\mu}\nabla p. \tag{14}$$

Both the formation permeability, k, and the fluid viscosity, μ, can be affected by the invaded solid particles, ∇p is the pressure gradient and ϕ is the porosity. Combining equation (14) and equation (13), yields $$t_b = \frac{\phi\mu r_0}{k|\nabla p|}. \tag{15}$$

Substituting into (5) the flowing data: $r_o=10^{-4}$ m, μ=1 cp, ϕ=0.25, k=10 mD and
|∇p|=0.1

MPa/mm=0.1 GPa/m, then $t_b \approx 25$ ms. The frequency of pressure oscillation which would be consistent with the found average time of bridging, $t_b$, can be estimated by the following equation:

$$f_b \approx t_b^{-1} = \frac{k|\nabla p|}{\varphi\mu r_0} \tag{16}$$

which may be of the order of 40 Hz.

This frequency represents the lower boundary of the frequency range because it does not take into account the interactions between particles. A simple adjustment to allow for particle interaction is to reduce the distance that particles travel before collisions with other particles or pore walls. Since the size of the largest particles is about one order smaller than the average pore diameter, the time $t_b$ should be reduce to one order and the frequency estimate would be 10 times higher, i.e. about 400 Hz.

A more comprehensive estimate may based on the analysis of chaotic motion of particles when a dense suspension flows through porous medium. The bridging/arching phenomenon is the manifestation of the Reynolds effect, well known in the mechanics of granular materials, specifically with respect to the expansion of dense particle beds under shear. If the bed density is higher than the critical density, the relative motion of particles is accompanied by the increase in the bed porosity. If the bed density is lower than the critical one, the Reynolds effect is not observed. Thus, when a dense suspension flows through a porous medium, its density may eventually increase inside the narrow necks of pores due to the higher probability of collisions between particles there. The relative motion of particles inside the neck is controlled by the velocity profile in its cross-sectional area or the shear rate that can be estimated based on the following equation:

$$y = u/r_n \tag{17}$$

where the velocity u is given in equation (14) and $r_n$ is the radius of necks connecting pores.

The chaotic velocity of particle movement is of the order of $u_c$=dy, where d is the average particle size. The time of particle travel over the distance comparable to its size should be of the order $d/u_c=y^{-1}$ and therefore the appropriate frequency should be of the order of y. Using equations (14) and (17), the frequency estimate may be obtained by $$f_c \approx \frac{k|\nabla p|}{\varphi\mu r_n} \tag{18}$$

which is similar to equation (16). For the same data as above and $r_n$=0.01 mm, the calculated frequency is of the order of 400 Hz. The pressure gradient
|∇p| involved in equation (18) depends on the pressure amplitude created by the oscillator in the cavity inside the probe and also on the distance from the rock surface into the formation. Obviously, the pressure gradient will be highest at the sand face and it will decay with depth into the formation. This means that there is no unique optimal frequency for an efficient treatment. The slower the flow, the lower the frequency can be used for the pressure equalization enhancement. It would be ideal to activate the frequency range, but it may be technically difficult. It is expected that the vibration technique will be effective even with frequencies other than that considered optimal for a particular formation.

Vibrating should help to reach the rate of pressure equalization close to the rate of pressure redistribution corresponding to undamaged formation. Therefore, the time of vibration should be roughly the same as the time required to fill the cavity, or about 1 s. Higher or lower formation permeability and the depth of invasion can affect this time. Since the depth of invasion is usually shallower in low-permeability formations, the damage induced by mud invasion should be smaller. In all applications, if the formation permeability is not too low (above about 1 mD), both production and pressure equalization should not take more than a few seconds. The level of underbalance created may adjusted to the rock mechanical properties by slowing down the initial piston displacement and/or increasing the initial cavity.

In view of the foregoing it is evident that the present invention is well adapted to attain all of the objects and features hereinabove set forth, together with other objects and features which are inherent in the apparatus disclosed herein. As will be readily apparent to those skilled in the art, the present invention may easily be produced in other specific forms without departing from its spirit or essential characteristics. For example, the probe could be embodied in various other configurations that provide the advantages of the present invention. The present embodiment is, therefore, to be considered as merely illustrative and not restrictive. The scope of the invention is indicated by the claims that follow rather than the foregoing description, and all changes, which come within the meaning and range of equivalence of the claims, are therefore intended to be embraced therein.

What is claimed is:

1. An apparatus for measuring the pressure of an underground formation penetrated by a wellbore, comprising:

a housing positionable in the wellbore;

a probe operatively connected to said housing, said probe positionable in sealing engagement with a sidewall of the wellbore;

a piston contained in said probe and axially movable therein, said piston having an end positionable adjacent the sidewall of the wellbore and retractable therefrom whereby a cavity is defined for receiving fluid from the formation;

an oscillator operatively connected to the piston for fluctuating the fluid in the cavity, the oscillator being moveable relative to the piston and adapted to axially extend and retract from the piston; and a gauge for measuring the pressure of fluid in the cavity.

2. The apparatus as described in claim 1 wherein said probe has a packer adapted to seal with the sidewall of the wellbore.

3. The apparatus of claim 1 further comprising a seal between the piston and the probe.

4. The apparatus of claim 1 wherein the probe is extendable and retractable from the housing.

5. The apparatus of claim 1 wherein the piston has a chamber therein adapted to receive the oscillator.

6. The apparatus of claim 1 wherein the gauge is operatively connected to the cavity via a conduit.

7. The apparatus of claim 6 wherein the conduit extends through the piston.

8. The apparatus of claim 1 wherein said apparatus is a drill string.

9. The apparatus of claim 1 wherein said apparatus is a wireline tool.

10. An apparatus for measuring the pressure of an underground formation penetrated by a wellbore, comprising:

a housing positionable in the wellbore;

a probe operatively connected to said housing, said probe positionable in sealing engagement with a sidewall of the wellbore;

a piston contained in said probe and axially movable therein, said piston having an end positionable adjacent the sidewall of the wellbore and retractable therefrom whereby a cavity is defined for receiving fluid from the formation;

an oscillator operatively connected to the piston for fluctuating the fluid in the cavity, the oscillator being moveable relative to the piston, wherein movement of the oscillator vibrates fluid in the cavity; and a gauge for measuring the pressure of fluid in the cavity.

11. A method for measuring the pressure of an underground formation penetrated by a wellbore comprising the steps of:

placing a probe of a downhole tool in sealing engagement with a sidewall of the wellbore, the probe having a retractable piston therein defining a cavity;

retracting the piston within the probe such that an underbalance is created to draw fluid into the cavity;

equalizing the pressure in the cavity to the pressure of the formation;

rapidly oscillating the fluid in the cavity when the piston is one of retracted and retracting; and measuring the pressure in the cavity.

12. The method of claim 11 wherein the downhole tool is a wireline tool.

13. The method of claim 11 wherein the step of oscillating comprises extending and retracting an oscillator in the piston to vibrate fluid in the cavity.

14. The method as described in claim 11 wherein the step of placing comprises extending a probe with a packer thereon against a mudcake lining the wellbore to create a seal therewith, the probe having a retractable piston therein defining a cavity.

15. The method of claim 11 wherein the cavity is less than about 1 cu. cm.

16. The method of claim 11 wherein the step of retracting comprises decompressing formation fluid in the cavity by quickly displacing the piston a short distance into the probe and away from the formation interface.

17. The method of claim 16 wherein said piston is retracted such that the fluid continuity is broken and the pressure of the fluid drops to zero.

18. The method of claim 17 wherein the piston displacement is determined by estimating the initial cavity volume and taking into account fluid compressibility while neglecting fluid flow into the cavity.

19. The method of claim 18 wherein the piston displacement is determined from the following equation:

$$\Delta\delta \geqq \delta\Delta p/K$$

where $\Delta p = p_w$ is the pressure variation and K is the bulk modulus of fluid or the mixture of fluid and mud cake.

20. The method as described in claim 11 further comprising the steps of loosening external mudcake and mobilizing internal mudcake.

21. The method as described in claim 20 wherein the oscillator creates periodic pressure variations in the cavity, the pressure variations having a pressure amplitude.

22. The method as described in claim 21 wherein said pressure amplitude is determined from the following equation:

$$\Delta p = \rho_f C_f \omega$$

where $\rho_f$ is the density of fluid (suspension) inside the volume, $\omega$ is the velocity of fluid displacement by the oscillator and $C_f$ is the sound velocity.

23. The method as described in claim 11 further comprising estimating the oscillation frequency of the pressure inside the confined fluid volume.

24. The method as described in claim 23 wherein an optimum pressure oscillation frequency is determined by the characteristic time of particle travel within the neck of a pore in a formation, where time is estimated by the following equation:

$$t_b \approx r_n / u$$

where $r_n$ is the neck radius and u is the Darcy flow velocity.

25. The method as described in claim 24 wherein said oscillating frequency estimation is obtained by the following equation:

$$f_e \approx k|\nabla p| / \phi \mu r_n$$

where k is the formation permeability, μ is the fluid viscosity, ∇p is the pressure gradient and ϕ is the porosity.

26. The method as described in claim 25 wherein pressure gradient |∇p| depends on the pressure amplitude created by the oscillator in the cavity inside the probe and also on the distance from the rock surface into the formation.

27. The method of claim 11 further comprising analyzing the pressure measurements to determine downhole parameters.

28. The method of claim 11 wherein the downhole tool is a drilling tool.

29. A probe for measuring the pressure of an underground formation penetrated by a wellbore, comprising:

a piston contained in said probe and axially movable therein, said piston having an end positionable adjacent the sidewall of the wellbore and retractable therefrom whereby a cavity is defined for receiving fluid from the formation;

an oscillator selectively positionable in the cavity for fluctuating the fluid in the cavity, wherein the oscillator and the piston are actuated independently; and a gauge for measuring the pressure of fluid in the cavity.

30. The probe of claim 29 wherein the gauge is operatively connected to the cavity via a conduit.

31. The probe of claim 30 wherein the conduit extends through the piston.

32. The probe of claim 29 wherein said probe is operatively connected to at least one of a drill string and a wireline tool.

33. The probe of claim 29 wherein the oscillator is at least partially disposed in the piston.

* * * * *